US010005175B2

(12) United States Patent
Morris

(10) Patent No.: US 10,005,175 B2
(45) Date of Patent: Jun. 26, 2018

(54) STEERING SHOCK COMPRESSOR SYSTEMS AND METHODS

(71) Applicant: Tiger Tool International Incorporated, Abbotsford (CA)

(72) Inventor: Patrick Andrew Morris, Morgantown, WV (US)

(73) Assignee: Tiger Tool International Incorporated, Abbotsford (CA)

( * ) Notice: Subject to any disclaimer, the term of this patent is extended or adjusted under 35 U.S.C. 154(b) by 291 days.

(21) Appl. No.: 14/699,454

(22) Filed: Apr. 29, 2015

(65) Prior Publication Data

US 2015/0314430 A1 Nov. 5, 2015

Related U.S. Application Data

(60) Provisional application No. 61/986,362, filed on Apr. 30, 2014.

(51) Int. Cl.
*B25B 27/30* (2006.01)
*B25B 27/00* (2006.01)

(52) U.S. Cl.
CPC ..... *B25B 27/0035* (2013.01); *B25B 27/302* (2013.01); *B25B 27/304* (2013.01)

(58) Field of Classification Search
CPC . B25B 13/465; B25B 27/0035; B25B 27/302; B25B 27/304; B25B 5/102; B25B 1/103; B25B 1/125; B24B 13/467; B25G 1/005
See application file for complete search history.

(56) References Cited

U.S. PATENT DOCUMENTS

2010/0283193 A1* 11/2010 Huang ..... B60G 11/15 267/140.2

FOREIGN PATENT DOCUMENTS

DE 19631524 C1 * 11/1997 ..... B25B 27/304
EP 0988937 A2 * 3/2000 ..... B25B 1/103

* cited by examiner

*Primary Examiner* — Christopher M Koehler
*Assistant Examiner* — Joel Crandall
(74) *Attorney, Agent, or Firm* — Michael R. Schacht; Schacht Law Office, Inc.

(57) ABSTRACT

A shock compression tool has a first end assembly defining a main axis and a first engaging surface, a second end assembly the second end assembly defining second and third engaging surfaces. The second end assembly is supported for movement along the main axis relative to the first end assembly. A drive system displaces the second end assembly along the main axis relative to the first end assembly such that a distance between the first engaging surface and the second engaging surface may be altered, and a distance between the first engaging surface and the third engaging surface may be altered. The first engaging surface and the second engaging surface define a first reference line. The first engaging surface and the third engaging surface define a second reference line. At least a portion of the first reference line is spaced from at least a portion of the second reference line.

11 Claims, 8 Drawing Sheets

STEERING SHOCK COMPRESSOR SYSTEMS AND METHODS

RELATED APPLICATIONS

This application, U.S. patent application Ser. No. 14/699,454 filed Apr. 29, 2015, claims benefit of U.S. Provisional Application Ser. No. 61/986,362 filed Apr. 30, 2014, the contents of which are incorporated herein by reference.

TECHNICAL FIELD

The present invention relates to systems and methods for installing steering shock absorbers and, more particularly, to such systems and methods that easily accommodate different steering systems and configurations.

BACKGROUND

Steering systems for vehicles commonly use a steering shock absorber. The steering shock absorber is or may be conventional and typically includes a cylinder, a rod, and a spring. The rod is supported by the cylinder for movement between retracted and extended positions. The spring biases the rod towards the extended position. To install the steering shock absorber, the rod typically must be forced from the extended position towards the retracted position against the bias force applied by the spring so that the shock absorber defines an installation length that allows the shock absorber to be installed onto the steering system.

The steering shock absorbers are considered sacrificial and are thus often replaced during repair and routine maintenance of the steering system. The steering shock absorbers are thus available in one of a variety of standard sizes and configurations, and a given size and configuration is typically specified for a particular steering system. Although the steering shock absorbers are typically standardized, the steering system itself will be designed for a particular vehicle.

Accordingly, while the process of installing a steering shock absorber is the same for steering systems in general (i.e., compressing the shock absorber to an installation length), the exact installation process for a given steering system will vary depending upon the particulars of that given steering system and the vehicle incorporating that given steering system.

The need exists for systems and methods of installing a steering shock absorber that can accommodate standardized steering shock absorbers and different steering systems and vehicles.

SUMMARY

The present invention may be embodied as a shock compression tool comprises a first end assembly defining a main axis and a first engaging surface, a second end assembly the second end assembly defining second and third engaging surfaces, and a drive system. The second end assembly is supported for movement along the main axis relative to the first end assembly. The drive system displaces the second end assembly along the main axis relative to the first end assembly such that a distance between the first engaging surface and the second engaging surface may be altered, and a distance between the first engaging surface and the third engaging surface may be altered. The first engaging surface and the second engaging surface define a first reference line. The first engaging surface and the third engaging surface define a second reference line. At least a portion of the first reference line is spaced from at least a portion of the second reference line.

The present invention may also be embodied as a method of compressing a shock absorber defining first and second shock openings comprising the following steps. A first end assembly defining a main axis and a first engaging surface is provided. A second end assembly defining second and third engaging surfaces is provided. The second end assembly is supported for movement along the main axis relative to the first end assembly. The second end assembly is arranged to define a first reference line extending between the first engaging surface and the second engaging surface. The second end assembly is displaced along the main axis relative to the first end assembly such that a distance between the first engaging surface and the second engaging surface is altered. The second end assembly is arranged to define a second reference line extending between the first engaging surface and the third engaging surface such that at least a portion of the first reference line is spaced from at least a portion of the second reference line. The second end assembly is displaced along the main axis relative to the first end assembly such that a distance between the first engaging surface and the third engaging surface is altered.

The present invention may also be embodied as a shock compression tool comprising a first end assembly, a second end assembly, and a drive system. The first end assembly defines a main axis and comprises a first end shaft defining a first engaging surface. The second end assembly comprises a second end shaft, a first cap member defining a second engaging surface, and a second cap member defining a third engaging surface. The first end shaft engages the second end shaft such that the second end shaft is movable along the main axis relative to the first end assembly. In a first configuration, the first cap member is detachably attached to the second end shaft to such that the first engaging surface and the second engaging surface define a first reference line. In a second configuration, the second cap member is detachably attached to the second end shaft to such that the first engaging surface and the third engaging surface define a second reference line. The first reference line is substantially parallel to the main axis, and the second reference line is angled with respect to the main axis. When the shock compression tool is in the first configuration, the drive system displaces the second end shaft relative to the first end shaft to alter a distance between the first and second engaging surfaces. When the shock compression tool is in the second configuration, the drive system displaces the second end shaft relative to the first end shaft to alter a distance between the first and third engaging surfaces.

DETAILED DESCRIPTION

Figure 1:
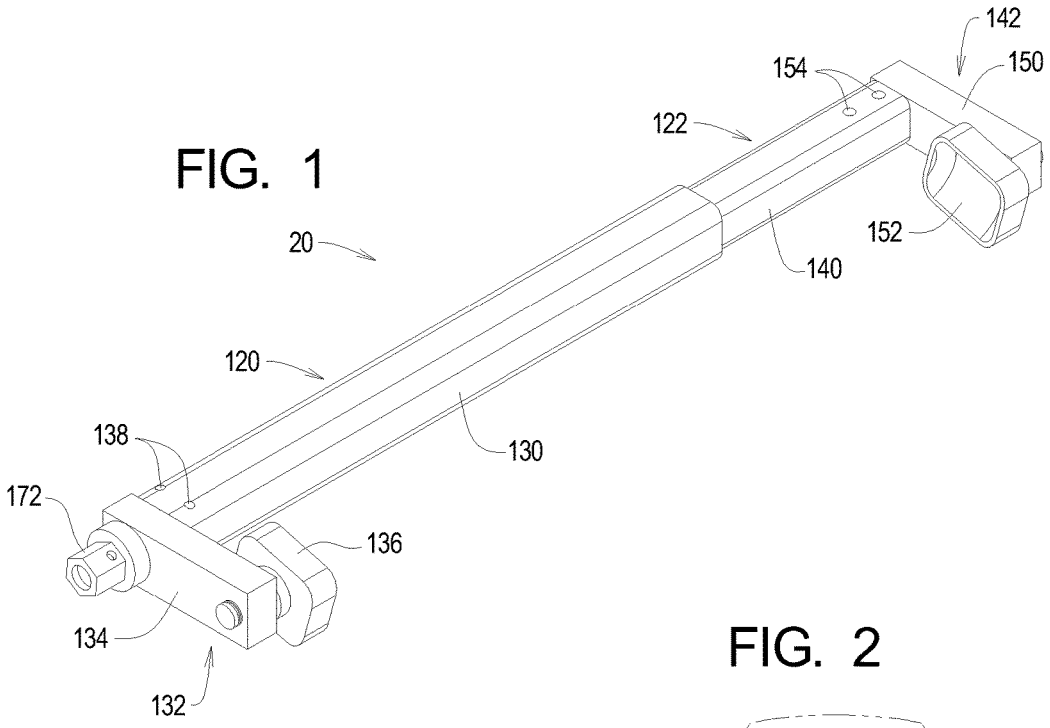
FIG. 1 is a perspective view of a first example steering shock compressor tool of the present invention.
Figure 2:
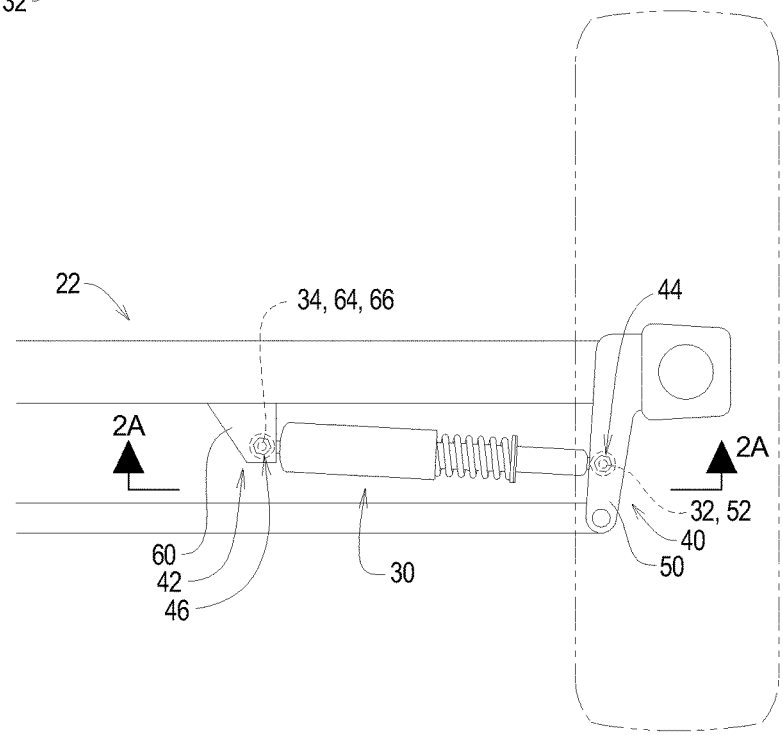
FIG. 2 is an elevation view of a first example type of steering system with which the first example compressor tool may be used.
Figure 3:
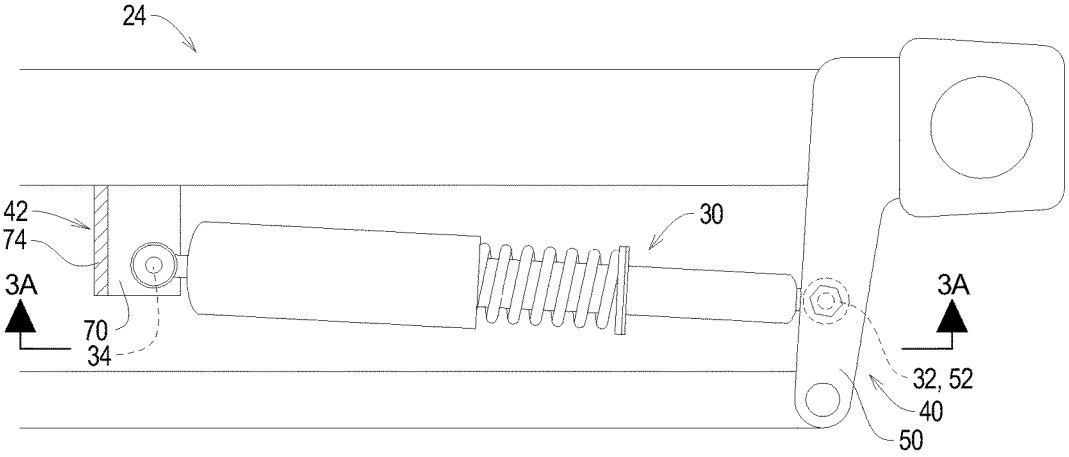
FIG. 3 is an elevation view of a second example type of steering system with which the first example compressor tool may be used.

Referring initially to FIG. 1 of the drawing, depicted therein is a first example compression tool 20 constructed in accordance with, and embodying, the principles of the present invention. The example tool 20 is configured to work with a plurality of steering systems, and first and second example steering systems 22 and 24 are depicted in FIGS. 2 and 3, respectively. The first and second example steering systems 22 and 24 are or may be conventional and will be described herein only to that extent necessary for a complete understanding of the systems and methods of the present invention.

In particular, each of the steering systems 22 and 24 comprises a steering shock 30. As part of the example steering systems 22 and 24, the example steering shock 30 is or may be conventional and will be described herein only to that extent necessary for a complete understanding of the systems and methods of the present invention. As perhaps best shown in FIGS. 2 and 2A, the example steering shock 30 defines a rod 32 and a cylinder 34 defining first and second shock openings 32*a* and 34*a*, respectively. A spring 36 biases the rod 32 to into an extended position relative to the cylinder 34. The first and second shock openings 32 and 34 allow the steering shock 30 to be arranged to form a part of the example steering systems 22 and 24 as will be described in further detail below.

The first and second example steering systems 22 and 24 each comprise a link structure 40, an anchor structure 42, a first bolt assembly 44, and a second bolt assembly 46, and the link structure 40 comprises a first link member 50 defining a first link opening 52. As is conventional, the first bolt assembly 44 is extended through the first link opening 52 and the first shock opening 32*a* to secure one end of the steering shock 30 to the first link member 50.

Figure 2A:
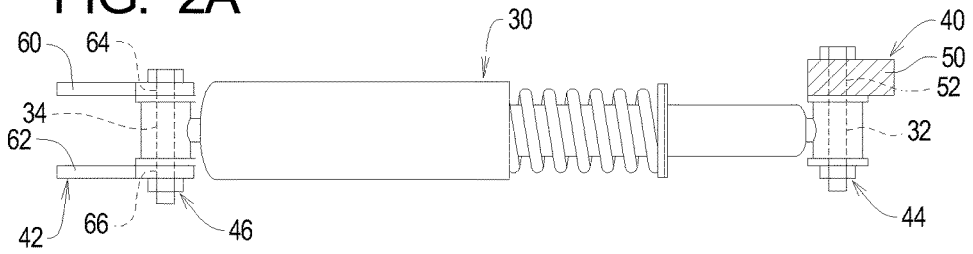
FIG. 2A is a bottom plan, section view illustrating portions of the first example type of steering system.

FIGS. 2 and 2A illustrate that the anchor structure 42 of the first example steering system 22 comprises first and second anchor flanges 60 and 62 defining first and second anchor openings 64 and 66. As is conventional, the second bolt assembly 46 is extended through the first anchor opening 64, the second shock opening 34*a*, and the second anchor opening 66 to secure another end of the steering shock 30 to the anchor structure 42. To align the first link opening 52 with the first shock opening 32*a* and the first and second anchor openings 64 and 66 with the second shock opening 34*a* to allow formation of the first and second bolt assemblies 44 and 46 as described above, the steering shock 30 must be compressed. The example compression tool 20 may be used to compress the steering shock 30 as will be described in further detail below.

Figure 3A:
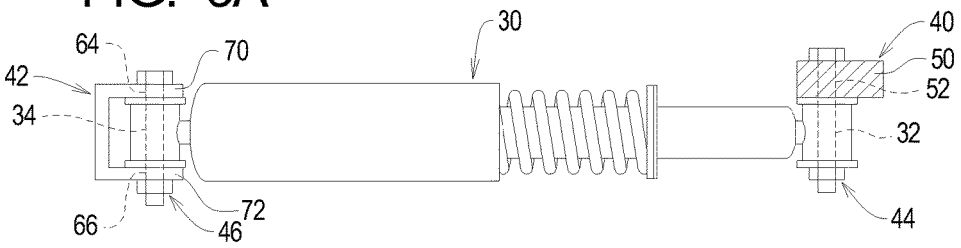
FIG. 3A is a bottom plan, section view illustrating portions of the second example type of steering system.

FIGS. 3 and 3A illustrate that the anchor structure 42 of the second example steering system 24 comprises a first side wall 70, a second side wall 72, and an end wall 74. The first and second side walls 70 and 72 define first and second anchor openings 64 and 66. As is conventional, the second bolt assembly 46 is extended through the first anchor opening 76, the second shock opening 34*a*, and the second anchor opening 78 to secure another end of the steering shock 30 to the anchor structure 42. To align the first link opening 52 with the first shock opening 32*a* and the first and second anchor openings 64 and 66 with the second shock opening 34*a* to allow formation of the first and second bolt assemblies 44 and 46 as described above, the steering shock 30 must be compressed. The example compression tool 20 may be used to compress the steering shock 30 as will be described in further detail below.

Referring now to FIGS. 4-7, the construction and use of the example compression tool 20 will now be generally described. The example compression tool 20 comprises a proximal end assembly 120, a distal end assembly 122, and a drive assembly 124.

The proximal end assembly 120 comprises a proximal shaft 130 and a proximal arm assembly 132. The proximal arm assembly comprises a proximal arm member 134, a proximal cap 136, and proximal pins 138.

The distal end assembly 122 comprises a distal shaft 140, a first distal arm assembly 142, and a second distal arm assembly 144. The first distal arm assembly 142 is detachably attached to the distal shaft 140 to place the compression tool 20 in a first configuration, and the second distal arm assembly 144 is detachably attached to the distal shaft 140 to place the compression tool 20 in a second configuration. In the first configuration, the compression tool 20 may be used to support the steering shock 30 while the steering shock 30 is used to form the first example steering system 22. In the second configuration, the compression tool 20 may be used to support the steering shock 30 while the steering shock 30 is used to form the second example steering system 24.

In particular, the example first distal arm assembly 142 comprises a distal arm member 150, a distal cap member 152, and first distal pins 154. A drive opening 156 is formed in the proximal arm member 134 to accommodate the drive assembly 124 as will be described in further detail below. The first distal pins 154 detachably attach the first distal arm member 150 to the distal shaft 140, and the first distal cap member 152 is detachably attached to the distal arm member 150. The example second distal arm assembly 144 comprises a distal support member 160, an offset cap member 162, second distal pins 164, and distal bolts 166. The second distal pins 164 detachably attach the distal support member 160 to the distal shaft 140, and the distal bolts 166 detachably attach the offset cap member 162 to the distal support member 160.

Figure 8:
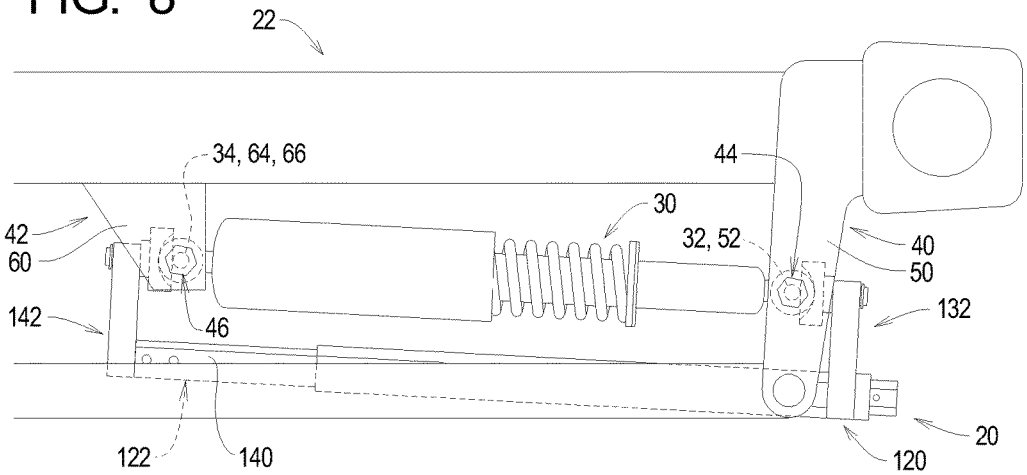
FIG. 8 is a side elevation view illustrating use of the use of the first example compressor tool in a first configuration to install a conventional steering shock assembly in the first example steering system depicted in FIGS. 2 and 2A.
Figure 9:
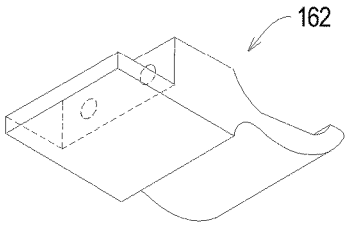
FIG. 9 is a perspective view of an offset cap member forming part of a first distal end assembly of the first example compressor tool.
Figure 9A:
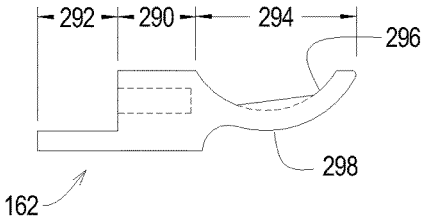
FIG. 9A is a side elevation view of the offset cap member depicted in FIG. 9.
Figure 10:
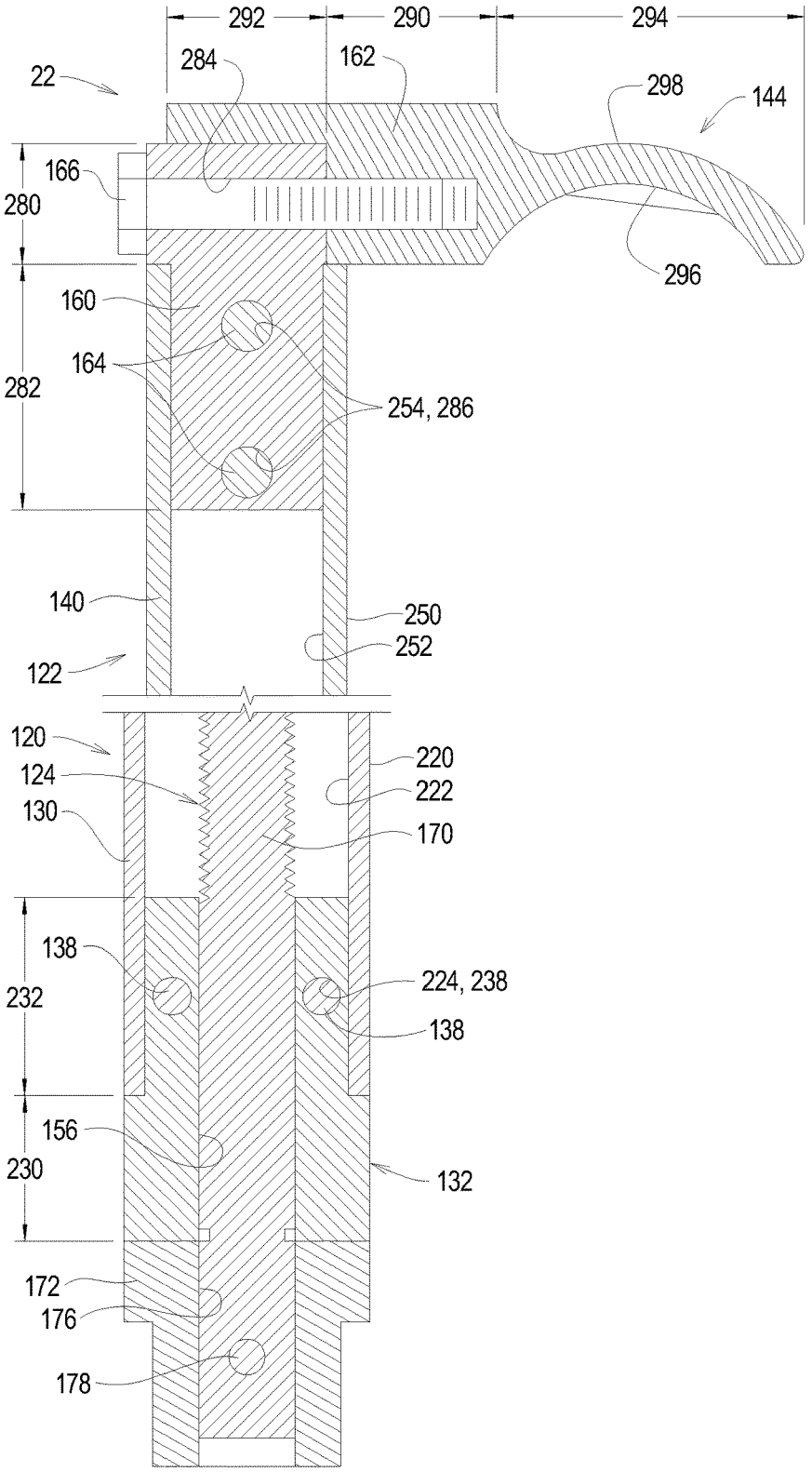
FIG. 10 is a close up view similar to FIG. 6 depicting the compressor tool in a second configuration.
Figure 11:
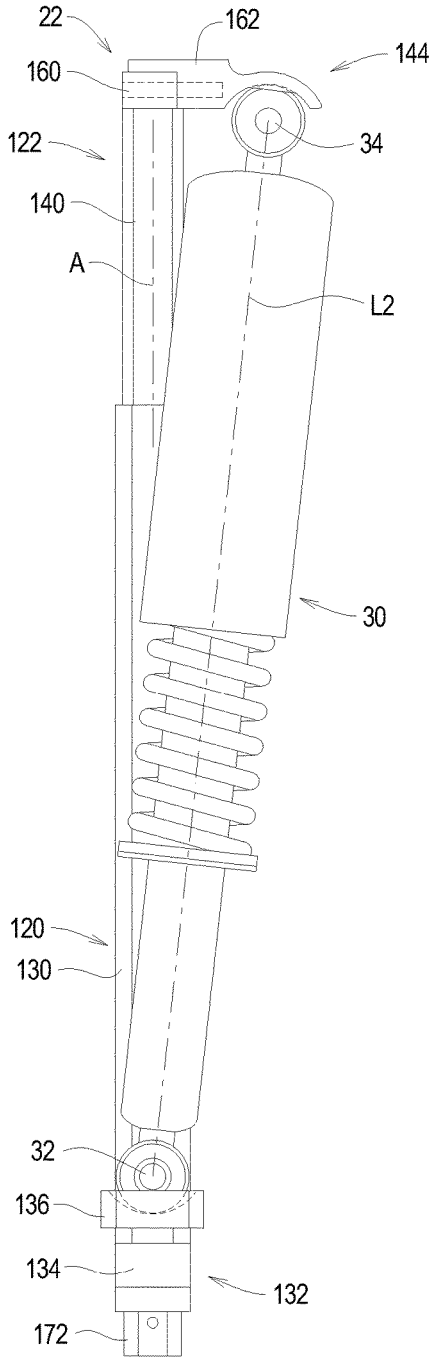
FIGS. 11 and 12 are elevation views illustrating the use of the compressor tool in the second configuration to compress a conventional steering shock assembly.
Figure 12:
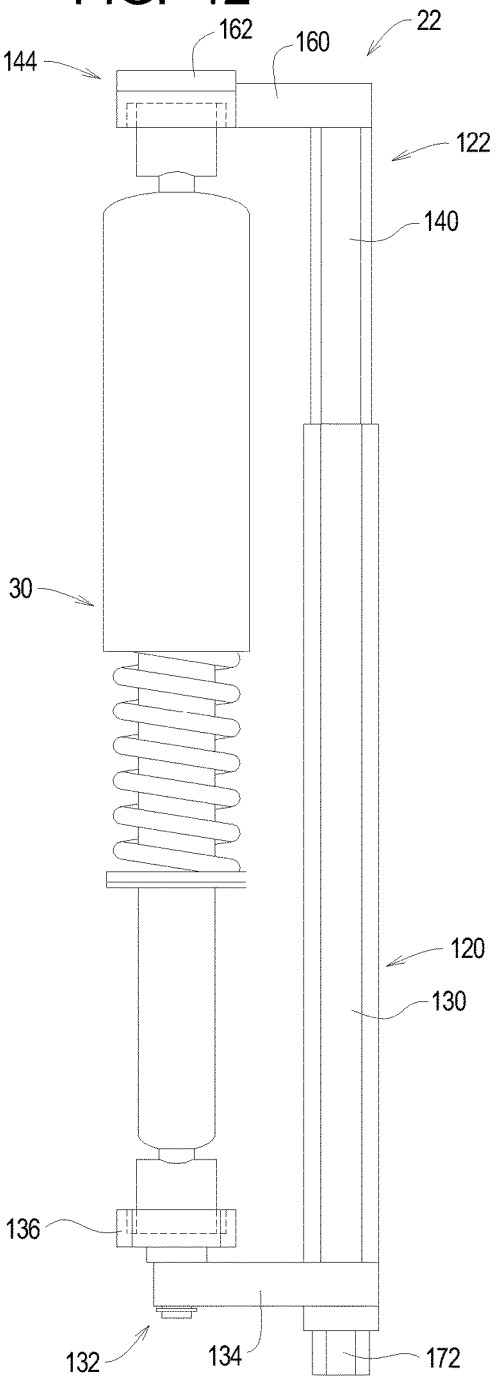
Figure 13:
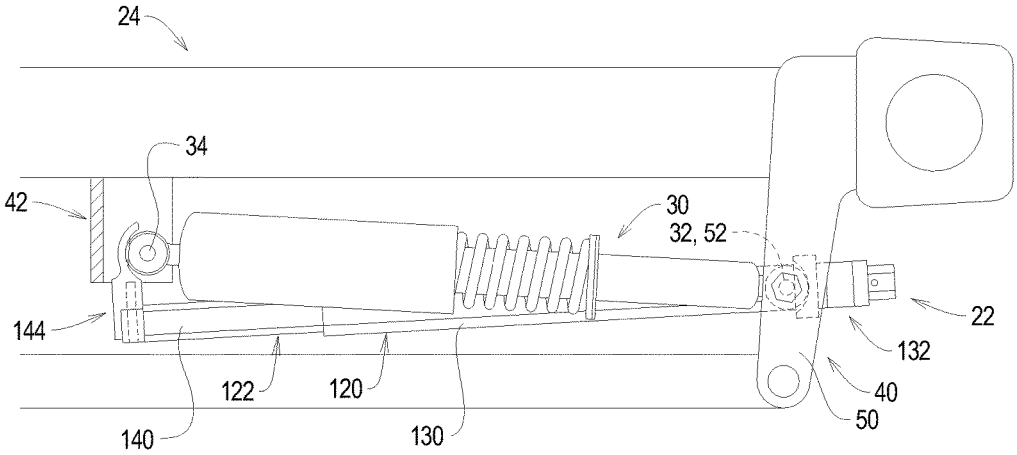
FIG. 13 is a side elevation view illustrating use of the use of the first example compressor tool in the second configuration to install a conventional steering shock assembly in the second example steering system depicted in FIGS. 3 and 3A.

The example drive assembly 124 comprises a drive shaft 170, a drive nut 172, a drive collar 174 defining a collar opening 176, and anchor pins 178. The anchor pins 178 secure the drive nut 172 to one end of the drive shaft 170. The drive collar 174 is secured to an inner end of the distal shaft 140, and the distal shaft 140 is telescopically received within the proximal shaft 130 such that the drive collar 174 is within the proximal shaft 130. The drive shaft 170 extends through the drive opening 156 and threadingly engages the collar opening 176. Rotation of the drive nut 172 causes axial rotation of the drive shaft 170. The drive shaft 170 engages the drive collar 174 such that axial rotation of the drive shaft 170 causes relative movement of proximal shaft 130 and the distal shaft 140 along a main axis A defined by the drive shaft 170 as shown by a comparison of FIGS. 4 and 5. Rotation of the drive nut 172 thus allows the proximal and distal end assemblies 120 and 122 to act on the steering shock 30 to compress the steering shock 30 as shown, for example, in FIGS. 8 and 13 to facilitate formation of the first and second steering systems 22 and 24.

With the foregoing general discussion of the construction and operation of the compression tool 20 in mind, the details of the construction and use of the example compression tool 20 will now be described.

The proximal end assembly 120 will now be described with reference to FIGS. 4-7. The example proximal shaft 130 is an elongate tubular structure having a rectangular cross-section and defining a proximal shaft outer wall 220, a proximal shaft inner wall 222, and proximal shaft pin openings 224. The example proximal arm member 134 comprises a proximal arm base portion 230, a proximal arm shaft engaging portion 232, and a proximal arm lateral portion 234. The example proximal arm member 134 further defines a proximal arm cap opening 236 and proximal arm pin openings 238. The example proximal cap member 136 defines a proximal cap base portion 240, a proximal cap engaging portion 242, and a proximal cap attachment portion 244. The example proximal cap engaging portion 242 defines a proximal cap engaging surface 246.

Figure 4:
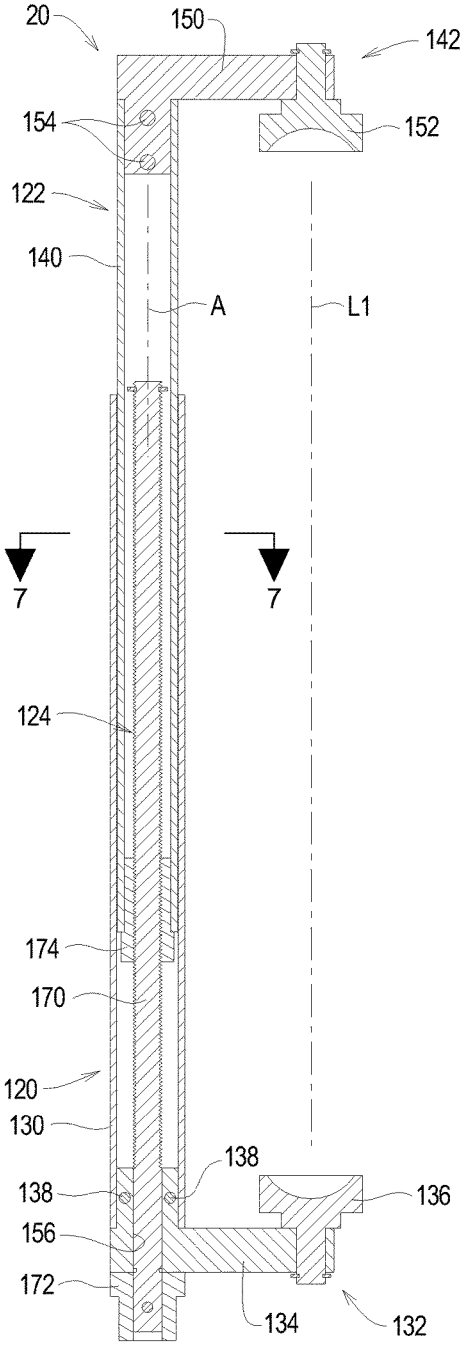
FIGS. 4 and 5 are side elevation, cut-away views illustrating the operation of the first example compressor tool.
Figure 5:
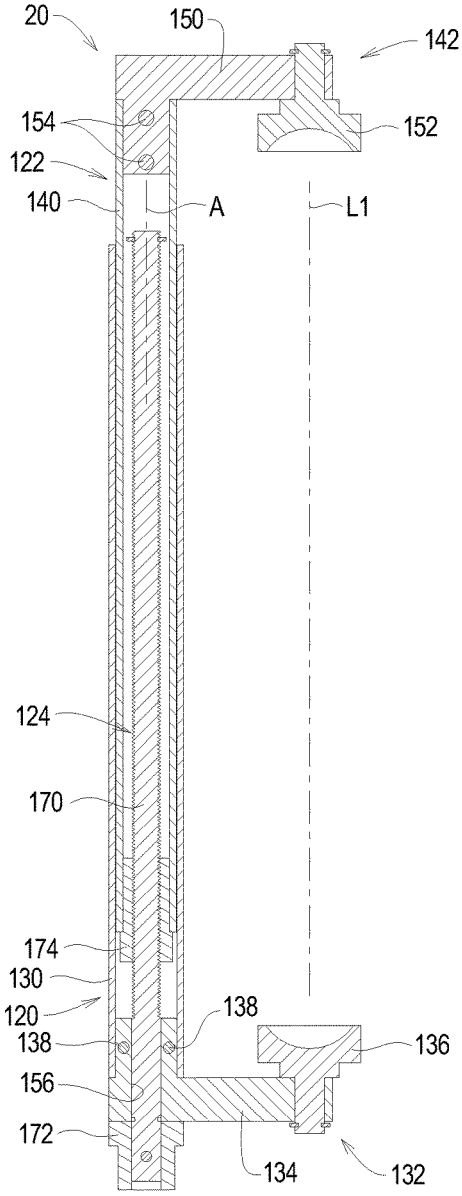
Figure 6:
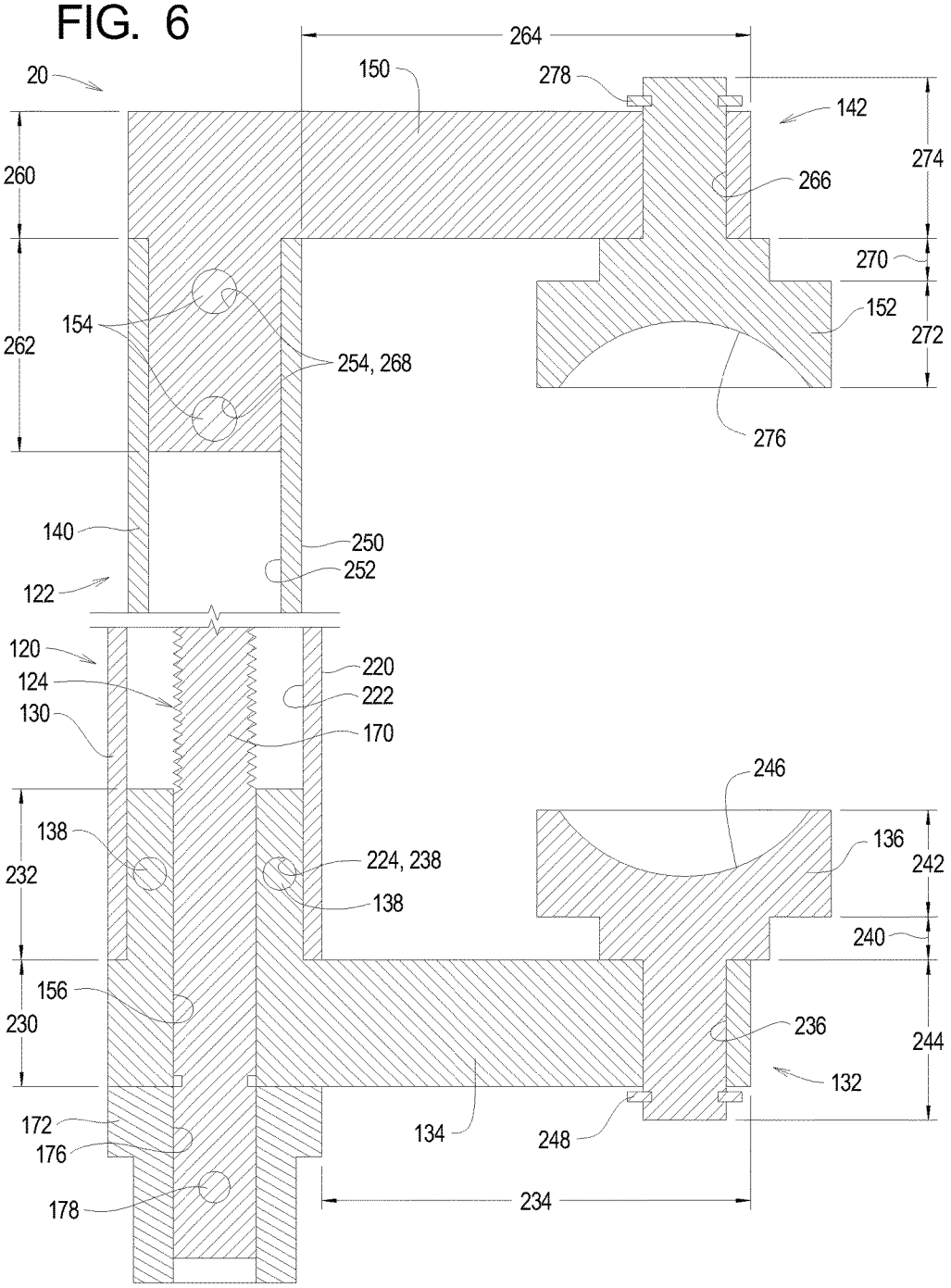
FIG. 6 is a close up view of portions of FIG. 4.
Figure 7:
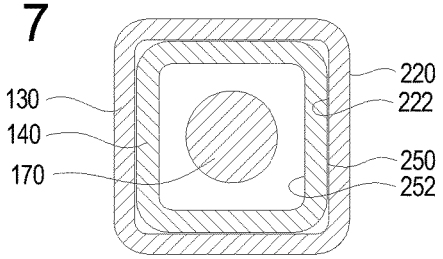
FIG. 7 is a section view taken along lines 7-7 in FIG. 4.

The proximal arm shaft engaging portion 232 is sized and dimensioned to snugly fit within the proximal shaft 130, and the proximal pins 138 extend through the proximal shaft pin openings 224 and the proximal arm pin openings 238 to secure the proximal arm assembly 132 in place relative to the proximal shaft 130 as shown in FIGS. 4-6. The proximal cap attachment portion 244 extends through the proximal arm cap opening 236 such that the proximal cap member 136 is rotatably supported by the proximal arm member 134. A proximal retainer clip 248 may be used to prevent inadvertent removal of the proximal cap member 136 from the proximal arm member 134.

The distal end assembly 122 will now be described with reference to FIGS. 4-7 and 10. The example distal shaft 140 is an elongate tubular structure having a rectangular cross-section and defining a distal shaft outer wall 250, a distal shaft inner wall 252, and proximal shaft pin openings 254.

The example distal arm member 150 comprises a distal arm base portion 260, a distal arm shaft engaging portion 262, and a distal arm lateral portion 264. The example distal arm member 150 further defines a distal arm cap opening 266, and distal arm pin openings 268. The example distal cap member 152 defines a distal cap base portion 270, a distal cap engaging portion 272, and a distal cap attachment portion 274. The example distal cap engaging portion 272 defines a distal cap engaging surface 276.

The distal arm shaft engaging portion 262 is sized and dimensioned to snugly fit within the distal shaft 140 to allow the compression tool 20 to be arranged in its first configuration. To secure the distal end assembly 122 in the first configuration, the first distal pins 154 extend through the distal shaft pin openings 254 and the distal arm pin openings 268 to secure the first distal arm assembly 142 in place relative to the distal shaft 140 as shown in FIGS. 4, 5, and 6. Further, the distal cap engaging portion 272 is arranged to extend through the distal arm cap opening 266 such that the distal cap member 152 is rotatably supported by the distal arm member 150. A distal retainer clip 278 may be used to prevent inadvertent removal of the distal cap member 152 from the distal arm member 150.

The example distal support member 160 comprises a distal support base portion 280 and a distal support shaft engaging portion 282. The example distal support member 160 further defines a distal base bolt opening 284 and distal base pin openings 286. The example offset cap member 162 defines an offset portion 290, an offset brace portion 292, and an offset engaging portion 294. The offset engaging portion 294 defines an offset engaging surface 296 and an offset clearance surface 298.

The distal base shaft engaging portion 282 is sized and dimensioned to snugly fit within the distal shaft 140 to allow the compression tool 20 to be arranged in its second configuration. To secure the distal end assembly 122 in the second configuration, the second distal pins 164 extend through the distal shaft pin openings 254 and the distal base pin openings 286 to secure the second distal arm assembly 144 in place relative to the distal shaft 140 as shown in FIGS. 10-13. Further, the distal bolts 166 are arranged to rigidly secure the offset cap member 162 to the distal support member 160.

When the compression tool 20 is in its first configuration, the proximal cap 136 and distal cap 152 lie along a first reference line L1 that is substantially parallel to the shaft axis A as perhaps best shown in FIGS. 4 and 5. When the compression tool 20 is in its second configuration, the proximal cap 136 and offset cap 162 lie along a second reference line L2 that is not parallel to the shaft axis A as perhaps best shown in FIG. 11.

Further, the offset cap member 162 is configured such that the clearance surface 298 thereof allows the offset cap member 162 to fit within the side walls 70 and 72 and end wall 74 when the second shock opening 34*a* is aligned with the first and second anchor openings 76 and 78.

While the example compression tool 20 is constructed such that the example proximal cap member 136 defines a first engaging surface (the proximal cap engaging surface 246) and the first and second distal arm assemblies 242 and 244 define second and third engaging surfaces (e.g., the distal cap engaging surface 276 and the offset engaging surface 296), the proximal end assembly may define two engaging surfaces and the distal end assembly may define a single engaging surface. Further, a single member may be reconfigured to define the two engaging surfaces associated with the separate reference lines L1 and L2.

The example compression tool 20 as depicted in the drawing and described herein comprises a single proximal arm assembly 132 and a plurality of distal arm assemblies 142 and 144. As an alternative, two or more proximal arm assemblies of different configurations may be provided to establish additional reference lines spaced or offset from the example reference lines L1 and L2 described herein. For example, a proximal arm assembly may be provided that establish a third reference line L3 that is offset from or angled with respect to both of the first and second reference Lines L1 and L2. Such additional proximal arm assemblies provide additional flexibility for a particular configuration defined by a steering system. Further, more than two distal arm assemblies may be provided to yield a compression tool that is even more flexible.

The drive assembly of a compression tool of the present invention may be embodied in forms other than the example drive assembly 124 described herein. For example, a ratchet advance system may be used to advance the proximal end assembly 120 relative to the distal end assembly 122. A ratchet advance assembly uses manual force to advance the proximal end assembly 120 in a first direction relative to the distal end assembly 122 in small increments until the appropriate compression is applied to the steering shock 30. After the steering shock 30 is in place, a ratchet release is operated to allow movement of the proximal end assembly 120 in a second direction (opposite the first direction) relative to the distal end assembly 122. Other alternative drive assemblies that may be used as the drive assembly 124 include pneumatic or hydraulic drive systems capable of telescopically extending the distal end assembly 122 relative to the proximal end assembly 120. The exact nature of the drive assembly of a compression tool of the present invention will be determined based on factors such as the nature of the steering shock being compressed and the desired price point of the compression tool.

What is claimed is:

1. A method of compressing first and second steering shocks, where the first steering shock defines a first anchor structure and a first link member and the second steering shock defines a second anchor structure and a second link member, the method comprising the steps of:

providing a first end assembly comprising
a proximal shaft arranged along a main axis,
a proximal cap defining a first engaging surface,
a distal arm member, and
a distal support member;

providing a second end assembly comprising
a distal shaft;
a first distal cap defining second engaging surface, and
a second distal cap defining a third engaging surface;

supporting the second end assembly for movement along the main axis relative to the first end assembly;

detachably attaching the first distal cap to the distal shaft in a first configuration by supporting the first distal cap on the distal arm member, and detachably attaching the distal arm member to the distal shaft; and in the first configuration, arranging the proximal cap adjacent to the first anchor structure and the first distal cap adjacent to the first link member;

displacing the second end assembly along the main axis relative to the first end assembly such that a distance between the first engaging surface and the second engaging surface and an effective length of the first steering shock are altered;

detachably attaching the second distal cap to the distal shaft in a second configuration by supporting the second distal cap on the distal support member, and detachably attaching the distal support member to the distal shaft;

in the second configuration, arranging the proximal cap adjacent to the second anchor structure and the second distal cap adjacent to the second link member; and displacing the second end assembly along the main axis relative to the first end assembly such that a distance between the first engaging surface and the third engaging surface and an effective length of the second steering shock are altered.

2. A method as recited in claim 1, in which:

in the first configuration, the second end assembly defines a first reference line extending between the first engaging surface and the second engaging surface;

in the second configuration, the second end assembly defines a second reference line extending between the first engaging surface and the third engaging surface;

the first reference line is substantially parallel to the main axis; and the second reference line is angled with respect to the main axis.

3. A method as recited in claim 1, further comprising the step of configuring the proximal end shaft and the distal end shaft such that relative axial rotation of the proximal end shaft relative to the distal end shaft is prevented.

4. A method as recited in claim 1, in which the steps of displacing the second end assembly along the main axis relative to the first end assembly comprises the step of arranging a drive shaft to extend through the first end, where the drive shaft defines the main axis.

5. A method as recited in claim 1, in which the steps of displacing the second end assembly along the main axis relative to the first end assembly comprises the steps of:

providing a drive shaft defining a first threaded surface;

providing a drive collar defining a second threaded surface;

rigidly connecting the drive collar to the distal shaft; and engaging the first threaded surface with the second threaded surface; and axially rotating of the drive shaft relative to the first end shaft to displace the first end shaft along the main axis relative to the second end shaft.

6. A method of compressing first and second steering shocks, where the first steering shock defines a first anchor structure and a first link member and the second steering shock defines a second anchor structure and a second link member, the method comprising the steps of:

providing a first end assembly comprising
a proximal shaft arranged along a main axis,
a proximal cap defining a first engaging surface,
providing a distal arm member, and
a distal support member;

providing a second end assembly comprising
a distal shaft;
a first distal cap defining second engaging surface, and
a second distal cap defining a third engaging surface, where the second distal cap defines an offset portion, an offset brace portion, and an offset engaging portion, where the offset engaging portion defines a clearance surface sized and dimensioned to accommodate the second anchor structure of the second steering shock;

supporting the second end assembly for movement along the main axis relative to the first end assembly;

detachably attaching the first distal cap to the distal shaft in a first configuration by supporting the first distal cap on the distal arm member and detachably attaching the distal arm member to the distal shaft;

in the first configuration, arranging the proximal cap adjacent to the first anchor structure and the first distal cap adjacent to the first link member;

displacing the second end assembly along the main axis relative to the first end assembly such that a distance between the first engaging surface and the second engaging surface and an effective length of the first steering shock are altered;

detachably attaching the second distal cap to the distal shaft in a second configuration by detachably attaching the offset brace portion to the distal support member, supporting the second distal cap on the distal support member, and detachably attaching the distal support member to the distal shaft;

in the second configuration, arranging the proximal cap adjacent to the second anchor structure and the second distal cap adjacent to the second link member; and displacing the second end assembly along the main axis relative to the first end assembly such that a distance between the first engaging surface and the third engaging surface and an effective length of the second steering shock are altered.

7. A method as recited in claim 6, in which:

in the first configuration, the second end assembly defines a first reference line extending between the first engaging surface and the second engaging surface;

in the second configuration, the second end assembly defines a second reference line extending between the first engaging surface and the third engaging surface;

the first reference line is substantially parallel to the main axis; and the second reference line is angled with respect to the main axis.

8. A method as recited in claim 6, in which:

the step of providing the first end assembly comprises the step of providing a distal arm member and a distal support member;

the step of detachably attaching the first distal cap to the distal shaft comprises the steps of supporting the first distal cap on the distal arm member, and detachably attaching the distal arm member to the distal shaft; and step of detachably attaching the second distal cap to the distal shaft comprises the steps of supporting the second distal cap on the distal support member, and detachably attaching the distal support member to the distal shaft.

9. A method as recited in claim 6, further comprising the step of configuring the proximal end shaft and the distal end shaft such that relative axial rotation of the proximal end shaft relative to the distal end shaft is prevented.

10. A method as recited in claim 6, in which the steps of displacing the second end assembly along the main axis relative to the first end assembly comprises the step of arranging a drive shaft to extend through the first end, where the drive shaft defines the main axis.

11. A method as recited in claim 6, in which the steps of displacing the second end assembly along the main axis relative to the first end assembly comprises the steps of:

providing a drive shaft defining a first threaded surface;

providing a drive collar defining a second threaded surface;

rigidly connecting the drive collar to the distal shaft; and engaging the first threaded surface with the second threaded surface; and axially rotating of the drive shaft relative to the first end shaft to displace the first end shaft along the main axis relative to the second end shaft.

* * * * *